United States Patent [19]

Shen

[11] Patent Number: 4,921,289

[45] Date of Patent: May 1, 1990

[54] CYLINDRICAL LEVER TYPE LOCK STRUCTURE FOR HANDICAPPED PEOPLE

[76] Inventor: Chao C. Shen, No. 233, Sec. 2, Hai Tien Road, Tainan, Taiwan

[21] Appl. No.: 143,521

[22] Filed: Jan. 13, 1988

[51] Int. Cl.[5] ..... E05B 3/00

[52] U.S. Cl. ..... 292/336.3; 292/357; 70/107

[58] Field of Search ..... 292/336.3, 347, 352, 292/357, 358, 336.5; 70/107, 370

[56] References Cited

U.S. PATENT DOCUMENTS

| | | | |
|---|---|---|---|
| 1,480,650 | 1/1924 | Bacon | 70/370 |
| 2,733,088 | 1/1956 | Fisler et al. | 292/336.3 |
| 2,870,621 | 1/1959 | Schoepe | 70/451 |
| 2,995,396 | 8/1961 | Russell et al. | 292/336.3 |
| 3,136,572 | 6/1964 | Lytle | 292/336.3 |
| 3,298,094 | 1/1967 | Russell et al. | 292/357 |
| 3,390,558 | 7/1968 | Tornoe et al. | 70/107 |
| 3,503,233 | 3/1970 | Russell et al. | 70/370 |
| 3,621,685 | 11/1971 | Sargent | 70/107 |
| 4,201,069 | 5/1980 | Katayama et al. | 70/224 X |
| 4,381,656 | 5/1983 | Hayakawa | 70/370 X |
| 4,424,691 | 1/1984 | Foshee | 70/224 |
| 4,465,311 | 8/1984 | Austin | 292/336.3 |
| 4,586,354 | 5/1986 | Smith | 70/370 X |
| 4,838,053 | 6/1989 | Shen | 292/336.3 |

*Primary Examiner*—Gary L. Smith
*Assistant Examiner*—Michael Miliano
*Attorney, Agent, or Firm*—Bacon & Thomas

[57] ABSTRACT

A cylindrical lever type lock is disclosed having first and second spindle housings telescopically receiving an outer and inner spindle, respectively. The outer and inner spindles both have a protruding plate formed on one end for urging a bracket to pull a pole and therefore to open a door. An annular ring rotatably secured on an engaging pin is urgeable by a bar assembly from inside of the door to lock the outer spindle relative to the first spindle housing. An engaging pin, which is rotatable by a key, unlocks the blockage between the outer spindle and the first spindle housing. A pair of plates each having a pair of cutouts, a pair of oblique cutouts and a pair of triangular protrusions are securely mounted on opposite sides of the door to firmly support the first and second spindle housings in position.

3 Claims, 13 Drawing Sheets

CYLINDRICAL LEVER TYPE LOCK STRUCTURE FOR HANDICAPPED PEOPLE

BACKGROUND OF THE INVENTION

The present invention relates to an improved cylindrical lever type lock structure used by handicapped people for the purpose of facilitating operation and increasing durability.

It is very common that many public buildings are installed with special locks different from ordinary locks. These special locks which are designed for facilitating usage by handicapped people, usually have longer handles to increase leverage as well as strong springs therein whereby the handle will quickly return to its original position after it is turned and released.

However, one drawback of these conventional lever type locks for handicapped people is that the longer handle thereof produces a stong torsional force when being turned such that the lock body thereof is very easily impaired. Moreover, the handle itself also tends to be easily damaged or sags after frequent usage as is very commonly seen on the doors of many public buildings.

SUMMARY OF THE INVENTION

It is the purpose of the present invention, therefore, to mitigate and/or obviate the above mentioned drawbacks in the manner set forth in the detailed description of the preferred embodiment.

A primary objective of this invention is to provide an improved cylindrical lever type lock structure which is easily operable by handicapped people and is durable in the lock body and the handle.

Further objectives and advantages of the present invention will become apparent as the following description proceeds, and the features of novelty which characterize the invention are pointed out with particularity in the claims annexed to and forming a part of this invention.

BRIEF DESCRIPTION OF THE DRAWINGS

FIG. 7-1 is a partial cutaway perspective view showing the operation between the third bracket and the bar of the cylindrical lever type lock of FIG. 1;

FIG. 9-1 is a cutaway perspective view of the outer spindle of the cylindrical lever type lock of FIG. 1 in the locked state;

FIG. 9-2 is a view similar to FIG. 9-1 but showing the lock in the unlocked state;

FIG. 9-3 is a cutaway perspective view of the outer spindle of the cylindrical lever type lock of FIG. 1 showing the installation thereof;

DETAILED DESCRIPTION OF THE PREFERRED EMBODIMENT

Figure 1:
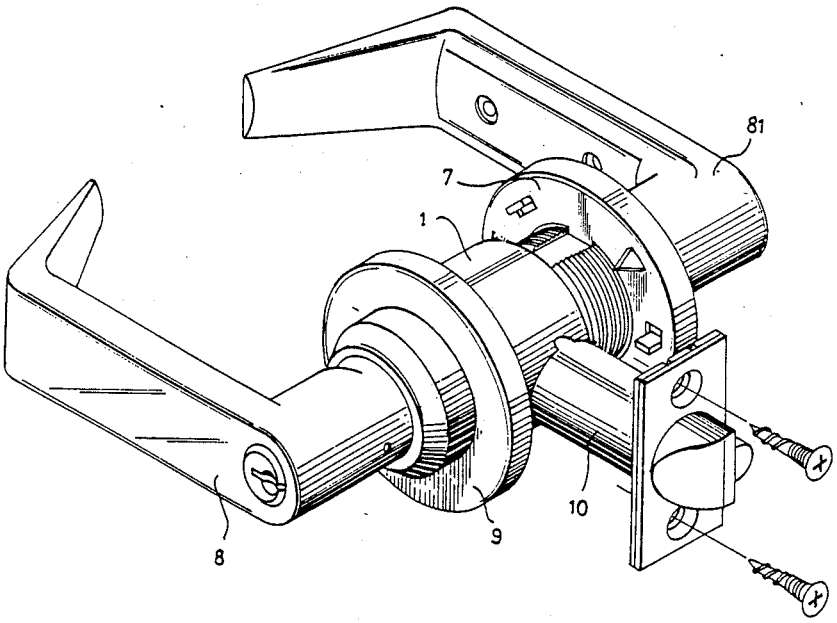
FIG. 1 is a perspective view of a cylindrical lever type lock for handicapped people in accordance with the present invention.
Figure 2:
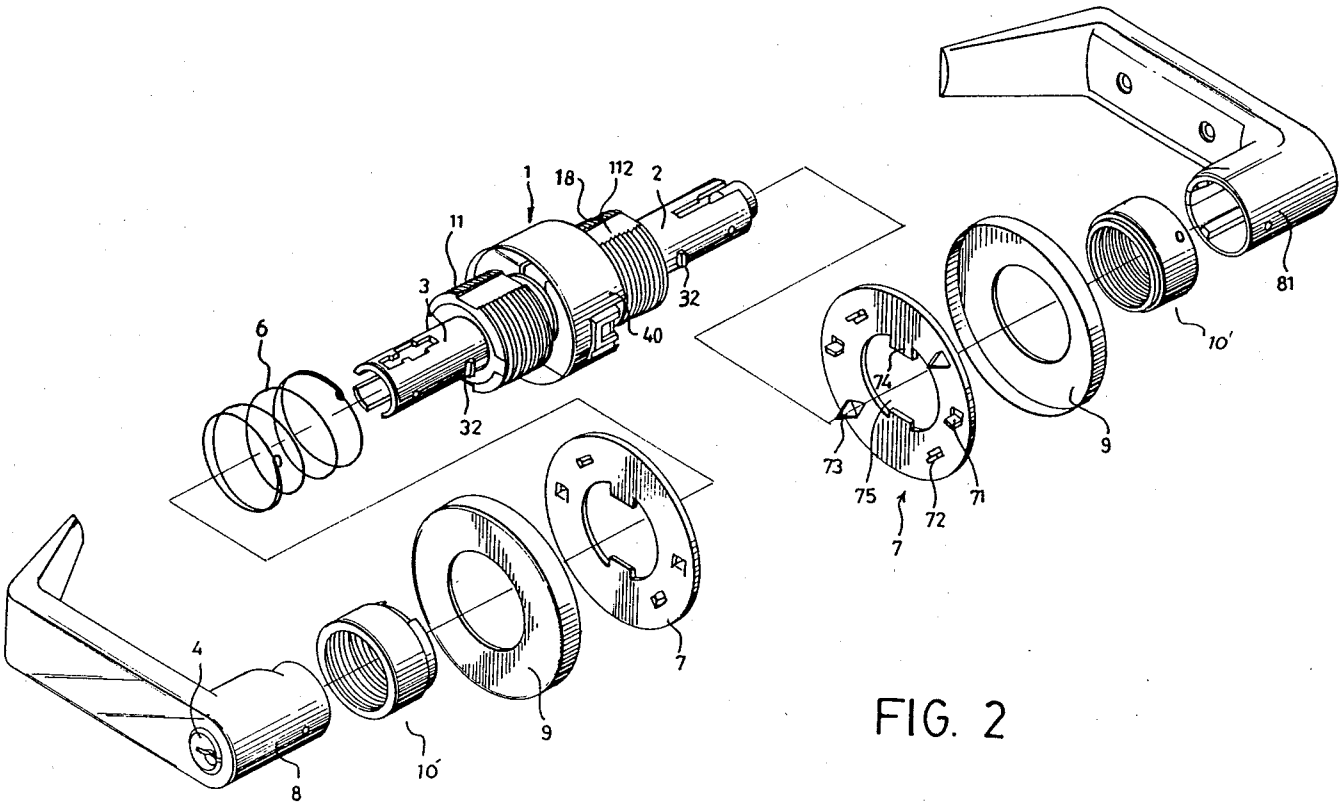
FIG. 2 is a partially exploded view of the cylindrical lever type lock of FIG. 1.

Referring to FIGS. 1 and 2, it can be seen that at the left and right sides of a lock body 1 of this invention are disposed an outer spindle 3 and an inner spindle 2, respectively, wherein a compression spring 6 is mounted around the first spindle housing 11. There are a pair of plates 7 and a pair of escutcheons 9, respectively mounted at either side of the lock body 1. The plates 7 and the escutcheons 9 are attached to the lock body 1 at the left and right sides by a pair of internally threaded cover rings 10' that screw on corresponding threaded portions on the lock body. An outer handle 8 and an inner handle 81 are releasably secured to the outer spindle 3 and inner spindle 2, respectively. The outer and inner spindles 8, 81 have respective holes thereon for engaging with a springy catch 32 which is secured on the spindles 8, 81. There is a keyway 4 on the outer handle 8 for a key to unlock the lock body 1.

Figure 11:
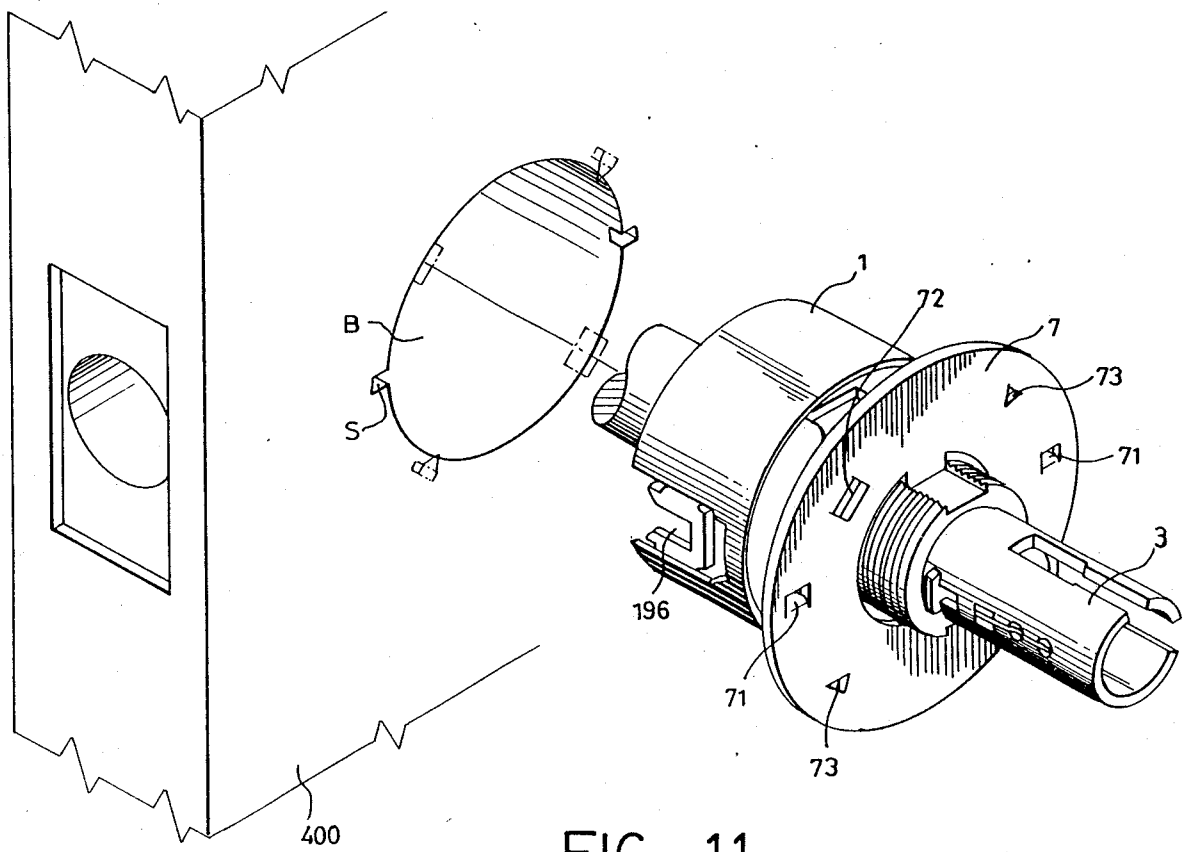
FIG. 11 shows the installation of the lock of this invention mounted on a wood door.
Figure 12:
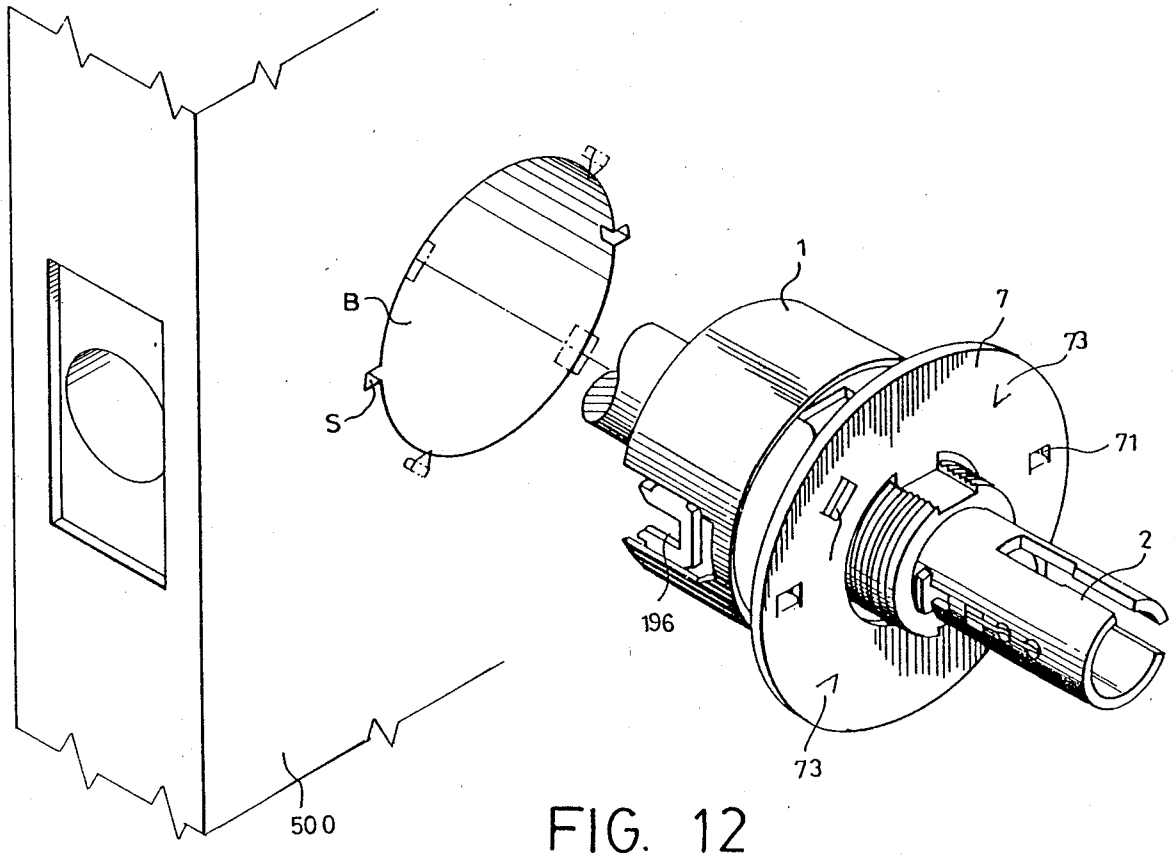
FIG. 12 shows the installation of the lock of this invention mounted on a metal door.

In the center of the plate 7 there is a hole 75 having two opposite protrusions 74. Around the periphery of the plate 7 there are disposed a pair of first cutouts 71, a pair of second cutouts 72 and a pair of triangular protrusions 73. When the lock body 1 is mounted within a big bore (designated by character B) on the door (numeral 400 or 500), respective grooves 112 disposed at diametrically opposite sides of the lock body are used to attach the protrusions 74 thereon. A pair of slots (designated by character S) are formed proximate to the big bore B to receive the pair of first cutouts 71, thereby firmly securing the lock body 1 on the door (400 or 500). The second cutouts 72 are mounted into the margins of the big bore B on the door and the triangular protrusions 73 are utilized to penetrate into a wood door 400, as shown in FIG. 11, or to be flattened when mounting on a metal door 500, as shown in FIG. 12. The first and second cutouts 71, 72 and the triangular protrusions 73 secure the lock in position so that it cannot be loosened by a large torsional force due to the long length and heavy weight of the outer handle 8 and the inner handle 81.

Figure 3:
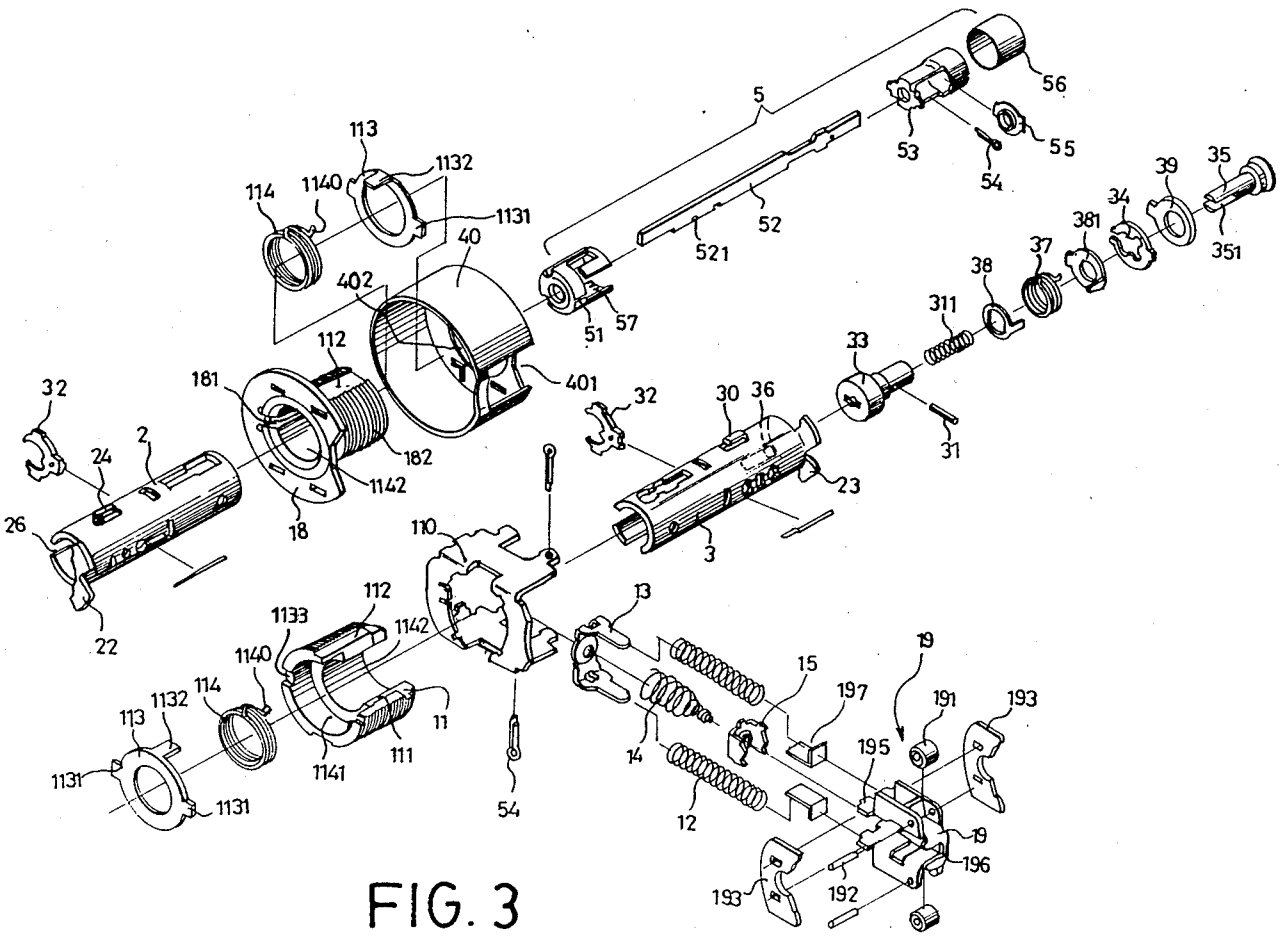
FIG. 3 is a further exploded view of the cylindrical lever type lock of FIG. 1.

Referring now to FIG. 3, it is shown that an encasing 40 receives a second spindle housing 18 and a first bracket 110. The first bracket 110 further fixedly receives a first spindle housing 11. The first and second spindle housings 11, 18 are both hollow to receive the inner and outer spindles 2, 3. The first and second spindle housings 11, 18 each have respectively central holes 1141 and 1142 therein. The first hole 1141 has a larger diameter than the second hole 1142. Both are disposed in a first groove 111 and a second groove 181 respectively on the first spindle housing 11 and the second spindle housing 18.

The first spindle housing 11 is firmly secured to a first bracket 110. The first bracket 110 is then mounted with a second bracket 13, a conical spring 14, a third bracket 15, a pair of springs 12, and a fourth bracket 19. A hook 196 is formed on the fourth bracket 19. The hook 196 is situated at the opening 401 of the encasing 40 (referring also to FIG. 2) and is engaged with a pole 10, as indicated in FIG. 1.

Figure 6:
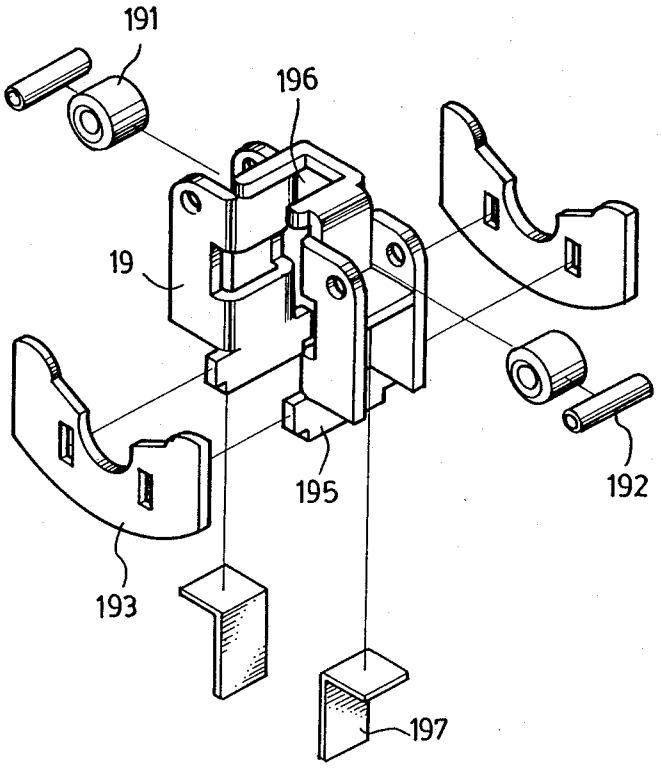
FIG. 6 is a perspective exploded view of the fourth bracket of the cylindrical lever type lock of FIG. 1.
Figure 7:
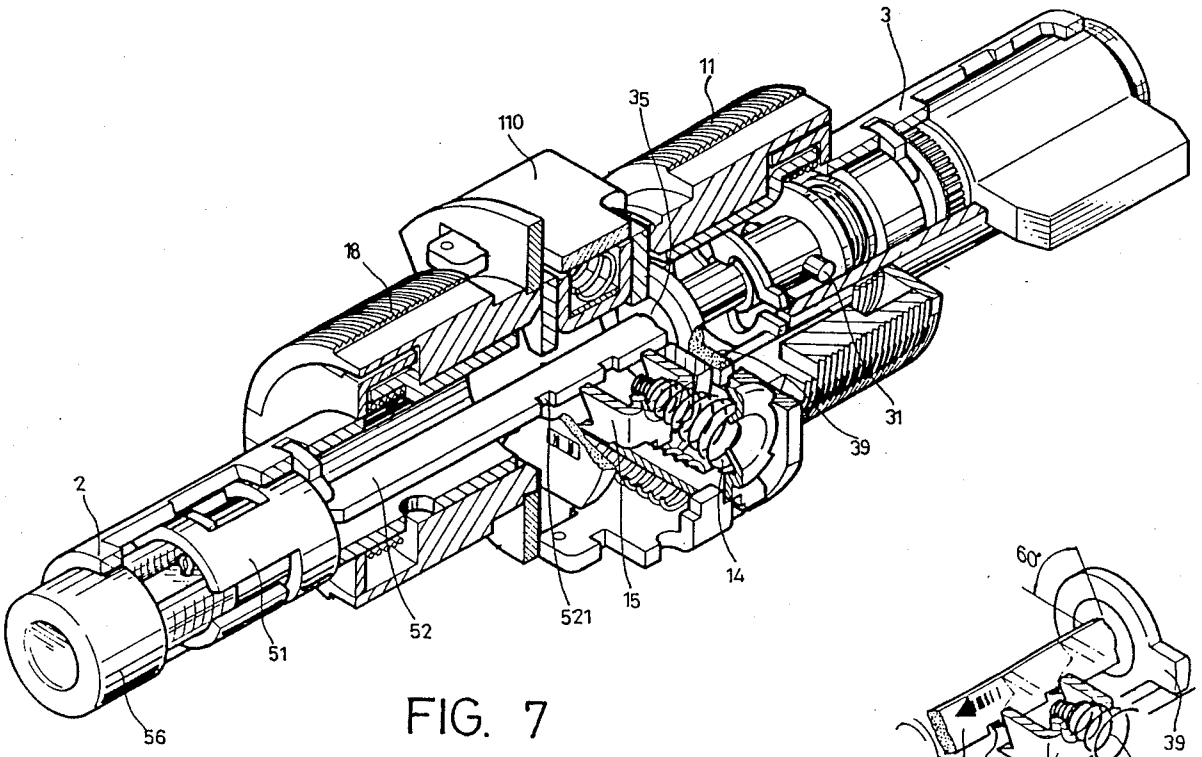
FIG. 7 is a perspective cutaway view of the lock body of the cylindrical lever type lock of FIG. 1 showing the lock in an unlocked state.
Figures 1, 7:
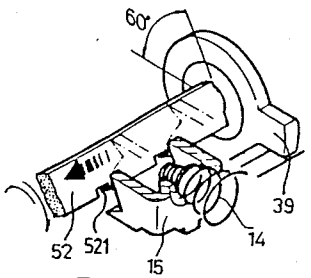
Figure 8:
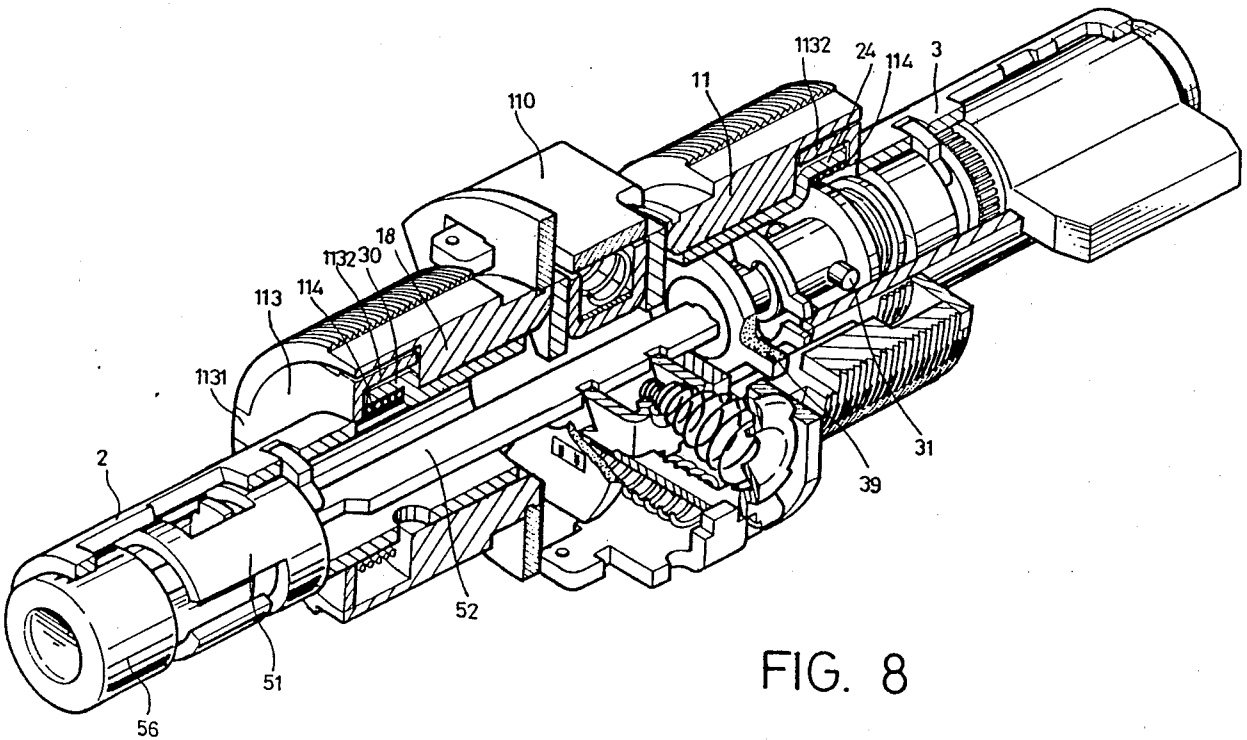
FIG. 8 is a view similar to FIG. 7 but showing the lock in a locked state.
Figures 2, 9:
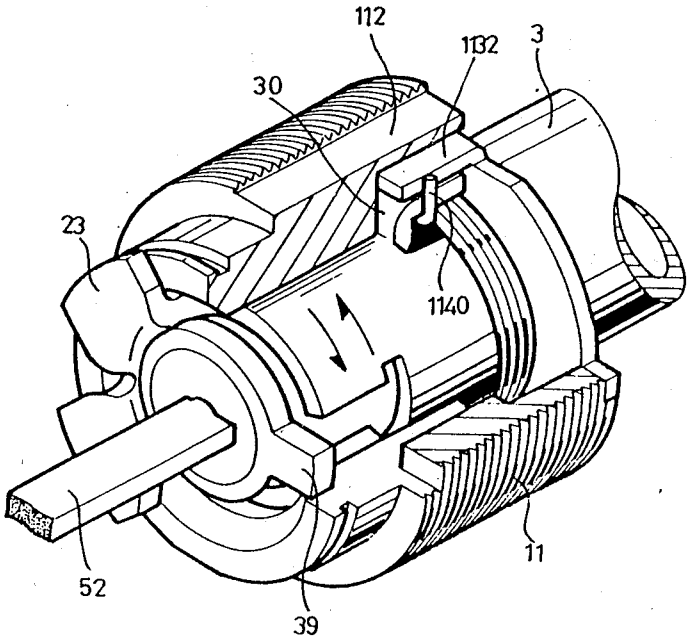
Figures 1, 9:
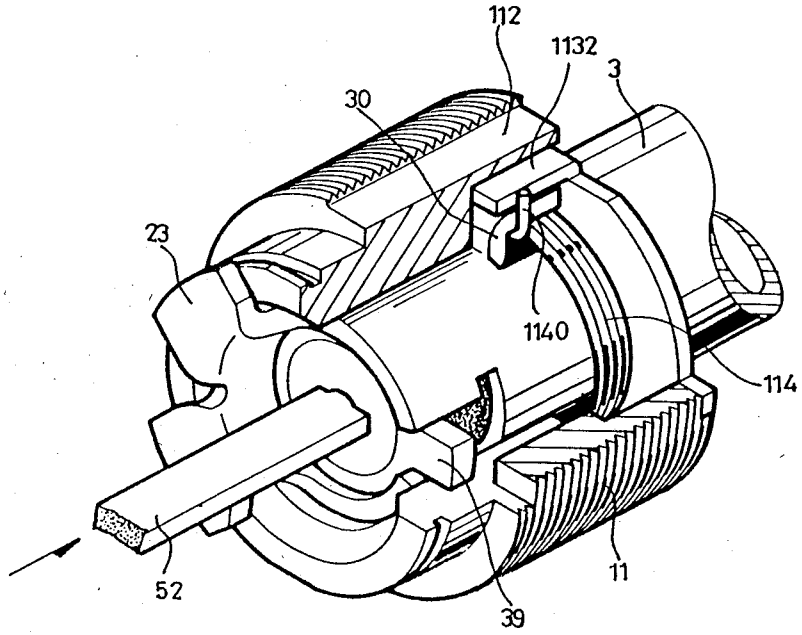
Figures 3, 9:
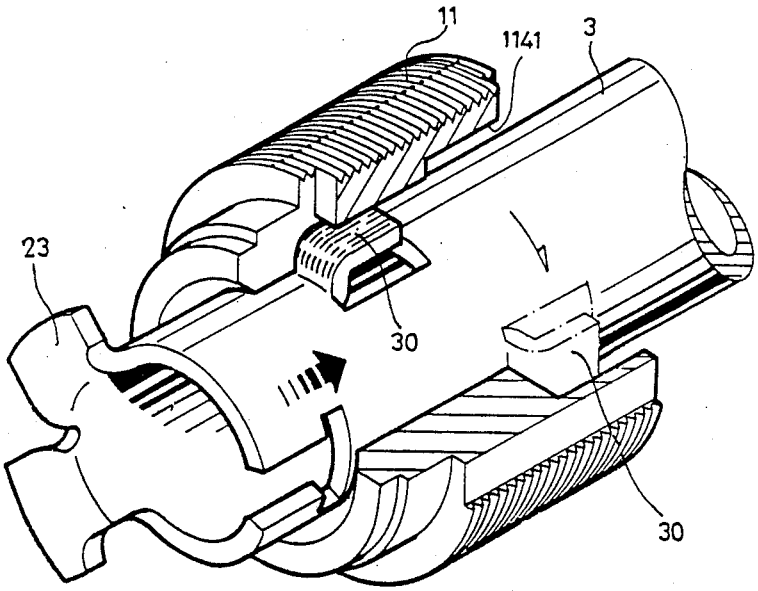
Figure 10:
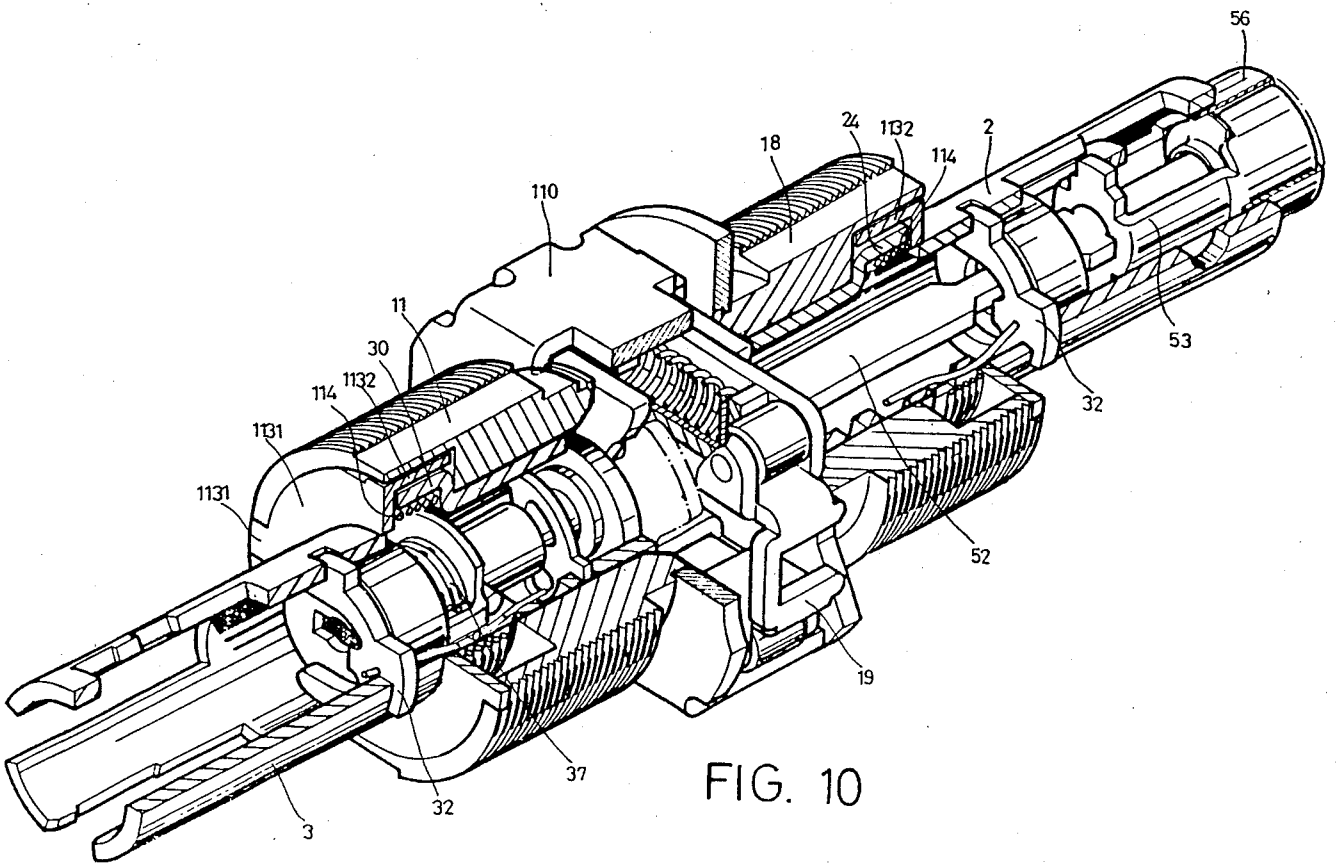
FIG. 10 is a cutaway perspective view of FIG. 7 showing the rear elevation.

Referring now to FIGS. 3–10, the outer and inner spindles 3 and 2, which are substantially the same in construction, are inserted respectively into corresponding first and second spindle housings 11 and 18 through the second hole 1142. A first bending protrusion 24 on the inner spindle 2 and a second bending protrusion 30 on the outer spindle 3 are alignable with and slidable in the second and first grooves 181 and 111, respectively. A pair of first protruding plates 22 are disposed at one end of the inner spindle 2 and a pair of second protruding plates 23 are disposed at one end of the outer spindle 3. A first opening 26 is provided on the inner spindle 2 and a second opening 36 is provided on the outer spindle 3. The second opening 36 cooperates with the first groove 111 and pertains to the locked or unlocked state of the lock which will be further described hereinafter. A torsional spring 114 is situated within respective first hole 1141 and outside the inner and outer spindles 2, 3. Two lateral protrusions 1131, one on either side of a spring seating 113, are engaged with a pair of grooves 1133 which are formed adjacent to the first hole 1141, thereby fastening the spring seating 113 in position. The spring seating 113 has also a longitudinal protruding tip 1132 which is mounted atop the first and second bending protrusions 24, 30 as shown in FIG. 8. Each side of the protruding tip 1132 is supported by a respective spring protrusion 1140 of the spring 114, so that when the outer handle 8 is turned or rotated, the outer spindle 3 rotates accordingly, thereby changing the condition of the lock from the locked state shown in FIG. 9-1 to the unlocked state shown in FIG. 9-2.

As the outer spindle 3 is turned, the second bending protrusion 30 thereon exerts a force on one of the spring protrusions 1140 of the spring 114 to turn and the other spring protrusion 1140 is prevented from moving because of the support of the positioning tip 1132 of the spring seating 113. In this way, the inner spindle 2 is prevented from moving by the securement of the spring seating 113 on the groove 1133 as well as by the retainment of the first bending protrustion 24 between the spring protrusions 1140. Therefore, the inner handle 81, or the outer handle 8, is prevented from loosening even though it is heavy.

Figure 4:
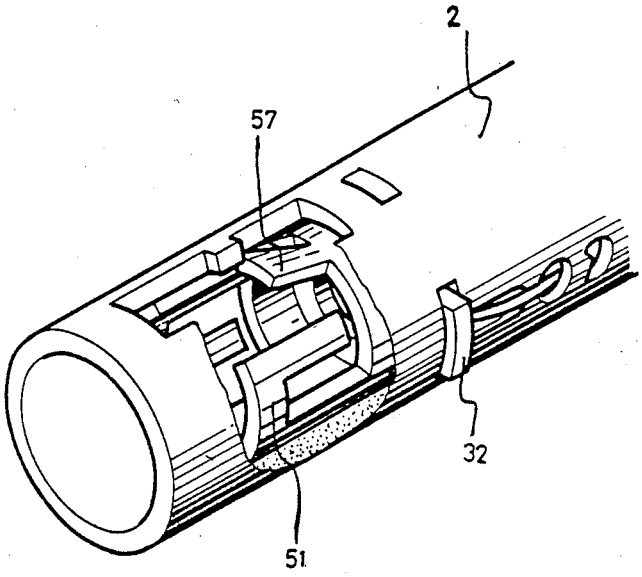
FIG. 4 is a partial perspective view of an inner spindle of the cylindrical lever type lock of FIG. 1.

Referring to FIGS. 3 and 4, it can be seen that inside the inner spindle 2, a bar assembly 5 is disposed in addition to the catch 32 which secures the inner handle 81 to the inner spindle 2 as described above. The bar assembly 5 comprises a correcting plate 55, a first container 53, a bar 52, a cover 56, and a first pin 54.

The correcting plate 55, which is fixedly secured on the first container 53, has a central hole engaged with one end of the bar 52 to keep or retain the bar 52 in a substantially central and balanced position. The bar 52 is securely mounted on the first container 53 by inserting the first pin 54 therethrough so that the bar 52 will not fall off. The second container 51 has a protrusion 57 formed thereon so that the bar assembly 5 can be put inside the inner spindle 2 and secured thereby bending the protrusion 57 outward (shown in FIG. 4).

Figure 5:
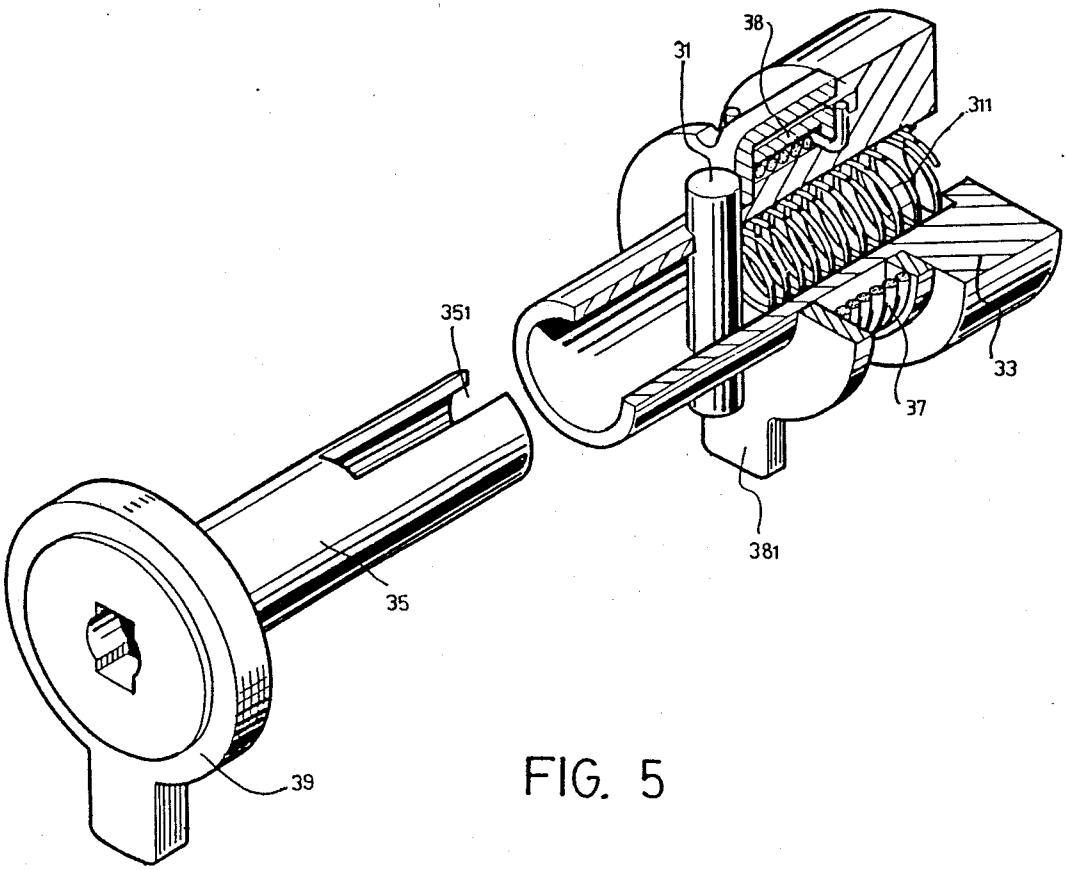
FIG. 5 is a partially cutaway perspective view of the outer spindle of the cylindrical lever type lock of FIG. 1 showing the construction therein.

The outer spindle 3 is substantially a hollow tube. A locking means is disposed within the outer spindle 3. The locking means comprises a second engaging pin 33, a second spring 311, an engaging pin 35 and an annular ring 39. The second engaging pin 33 is a stepped cylinder formed of three different portions, with middle portion thereof being flat on a pair of opposite sides to receive a third annular ring 38. The third annular ring 38, which also has a flat edge formed on the inner rim thereof, is rotatable with the second engaging pin 33. During assembly, a second spring 311 is first put within the second engaging pin 33, in which a flange on the second engaging pin 33 retains the second spring 311, as shown in FIG. 5. A second torsional spring 37, the third annular ring 38 and a second annular ring 381 are respectively mounted on the middle portion of the second engaging pin 33. With the third and second annular rings 38, 381 disposed outside the second torsional spring 37, bending protrusions of the third and second annular rings 38, 381 are situated between two free ends of the second torsional spring 37. A second pin 31 laterally penetrates through the second engaging pin 33 to fix the second annular ring 381 in position, as shown in FIG. 5. Finally, the engaging pin 35 is put inside the second engaging pin 33 and one end thereof is pressed upon the second spring 311. The end pressing upon the second spring 311 forms a second slot 351 which can accommodate the second pin 31 therein. Another protruding portion of the second annular ring 381 is securely mounted at the second opening 36 (shown in FIG. 3) of the outer spindle 3. Thus, the third annular ring 38, and therfore the second torsional spring 37, can be turned clockwise or counter-clockwise as desired. The second positioning plate 34 is then mounted on the outer spindle 3 to secure the whole assembly. The annular ring 39 and engaging pin 35 are rotatably secured together as shown in FIG. 5. With the engagement between the second indention 351 and the second pin 31, the engaging pin 35 is rotatable by the second engaging pin 33, and vice versa. It is noted that the rotation of the engaging pin 35 is independent of the annular ring 39. The above construction allows the engaging pin 35 to rotate along with the second engaging pin 33 so that the lock can be opened by turning a key in either direction, thus facilitating the operation thereof by a handicapped person for either door handle.

FIGS. 7 and 8 show the lock body 1 in unlocked and locked state, respectively. It is noted that pressing the cover 56 of the bar assembly 5 (referring to FIG. 7) moves or slides the bar 52 so that the second spring 311 is compressed and the protruding portion of the annular ring 39 falls into both the second opening 36 and the first groove 111 so that rotational movement of the first spindle housing 11 relative to the outer spindle 3 is blocked. Simultaneously, two indentations 521 on the bar 52 engage with and are retained by the third bracket 15, which is urged by the conical spring 14 (referring to FIG. 8). To open the lock body 1, a key is inserted into the keyway 4 and turned in either direction. Turning the key rotates the second engaging pin 33 and therefore the engaging pin 35, and in turn the bar 52, as shown in FIG. 7-1. The key rotates the bar 52 even in the condition that the annular ring 39 blocks the outer spindle 3 and the first spindle housing 11 since the engaging pin 35 rotates independently of the annular ring 39. As the bar 52 is turned to a proper angle, say 60 degrees as in FIG. 7-1, the two slots 521 of the bar 52 disengage from the third bracket 15. Simultaneously, the second spring 311 forces the engaging pin 35, and hence the bar 52, back to its original position. Then the cover 56 of the inner spindle 2 will bounce back and the annular ring 39 retracts from the second opening 36 of the outer spindle 3. In this way, the outer spindle 3 is turnable to open the lock body 1. Therefore, the bar 52 bounces back from the locked state shown in FIG. 9-1 to the unlocked state shown in FIG. 9-2.

Referring now to FIGS. 3 and 6, at one side of the fourth bracket 19 there is disposed a hook 196. At either side of the fourth bracket there is disposed a respective roller 191. The rollers 191 are mounted on the fourth bracket 19 by a pair of third pins 192, thereby increasing the reliability of the fourth bracket 19. Moreover, two pressing plates 193 are arranged on two protruding plates 195 at another side of the fourth bracket 19. A pair of L-shaped plates 197 are arranged on both sides of the fourth bracket 19. Also, a pair of springs 12 are enclosed by the first bracket 110. The L-shaped plates 197 and the first bracket 110 prevent the springs 12 from bending or loosening upon urging by the fourth bracket 19. It is noted that the fourth bracket 19 is urgeable by the engagement between the pressing plates 193 and the first or second protruding plates 22 or 23.

I claim:

1. In a cylindrical lever type lock structure for handicapped people having: outer and inner spindles rotatably received in first and second spindle housings, respectively, said inner spindle having a pair of first protruding plates and said outer spindle having a pair of second protruding plates thereon for urging a fourth bracket to open a door; an encasing and a first bracket engaged with said second and first spindle housing, respectively; a compression spring mounted around said first spindle housing, said first bracket being further engaged to said encasing; a plate and an escutcheons attached at left and right sides of a lock body by screwing a pair of cover rings thereon; and inner and outer handles releasably secured to said inner and outer spindles, respectively; the improvements in said cylindrical lever type lock structure for handicapped people comprising:

(a) said plate defines a pair of first cutouts, a pair of second cutouts and a pair of triangular protrusions thereon and has a central hole thereat with two opposite protrusions formed thereon, said first cutouts being insertable into a pair of slots formed proximate to a bore on a door for securing said lock body in position, said second cutouts being engageable with said bore to abut against and be supported by an edge of said bore, said triangular protrusions being penetrable into a wood door;

(b) said first and second spindle housings each defining respective first and second central holes, said first hole having a larger diameter than said second hole, said second hole on said first spindle housing defining a first groove and said second hole on said second spindle housing defining a second groove;

(c) first and second bending protrusions formed on the respective inner and outer spindles and aligned with an passable through said second and first grooves;

(d) a torsional spring with two protrusions located within the respective first hole and outside of said inner and outer spindles;

(e) a spring seating having a longitudinal protruding tip formed thereon secured proximate to each of said first holes, said protruding tip being mounted atop said first and second protrusions with said two protrusions of said torsional spring being positioned on opposite sides of said protruding tip;

(f) means for locking said outer spindle relative to said first spindle housing securely mounted inside said outer spindle, said means for locking comprising: a second engaging pin; a second spring; and engaging pin; an annular spring; said second engaging pin rotatably receives a third annular ring; a second spring located within said second engaging pin and being retained therein by a second pin; a second torsional spring, said third annular ring and a second annular ring respectively mounted on a middle portion of said second engaging pin; said third and second annular rings disposed outside said second torsional spring with bending protrusions of said third and second annular rings situated between two free ends of said second torsional spring, said second pin laterally penetrating through said second engaging pin to retain said second annular ring and said second spring in position; said engaging pin received by said second engaging pin with one end thereof receiving said second pin and pressing said second spring; said third annular ring turnable in both a clockwise and a counter-clockwise direction, said annular ring and said engaging pin rotatably secured together, said engaging pin rotatable by said second engaging pin; and, (g) a bar assembly securely mounted inside said inner spindle by a catch, said bar assembly comprising: a correcting plate; a first container; a bar; a cover; and a first pin; said correcting plate mounted within said first container, said first pin assembly with said first container and a second container, said second container having a protrusion thereon which is bendable so that said bar assembly secured to said inner spindle, said bar engaged with said engaging pin, a protruding portion of said annular ring slidable with said engaging pin to engage with both a second opening on said outer spindle and said first groove by pressing said cover so that rotational movement of said first spindle housing relative to said outer spindle is blocked; two indentations defined on said bar engaged to and retained by a third bracket which is urged by a conical spring, said second engaging pin turnable to rotate said engaging pin and said bar, said two indentations thereof disengaging from said third bracket and said second spring simultaneously forcing said engaging pin and said bar back to an original position.

2. The cylindrical lever type lock structure for handicapped people as claimed in claim 1, further comprising: an L-shaped plate disposed on both sides of said fourth bracket, said fourth bracket having a hook formed thereon and situated at an opening of said encasing to engage a pole, thereby preventing spring from bending or loosening and allowing said fourth bracket to move easily when pressure is applied thereto.

3. The cylindrical lever type lock structure for handicapped people as claimed in claim 1 further comprising: a pair of grooves defined on both sides of said first spindle housing; and said second spindle housing is engageable with said two opposite protrusions in said central hole on said plate so that said first and second spindle housings are retained in position when said outer spindle and said inner spindle are turned therewithin respectively.

* * * * *